US006108974A

United States Patent [19]

Herzog-Mesrobian et al.

[11] Patent Number: 6,108,974

[45] Date of Patent: Aug. 29, 2000

[54] COVER SLEEVE FOR POT

[76] Inventors: Patricia L. Herzog-Mesrobian, 9551 N. Wakefield Ct., Milwaukee, Wis. 53217; Amy R. Seibel, 11100 N. River Trail, Mequon, Wis. 53092

[21] Appl. No.: 09/181,357

[22] Filed: Oct. 28, 1998

[51] Int. Cl.[7] ..... A47G 7/08

[52] U.S. Cl. ..... 47/72; D11/143

[58] Field of Search ..... 47/41.01, 72, 84; 206/423; D11/143, 144, 164

[56] References Cited

U.S. PATENT DOCUMENTS

| | | | |
|---|---|---|---|
| 151,142 | 5/1874 | Lynch . | |
| D. 266,916 | 11/1982 | Kaufmann | D11/164 |
| D. 289,024 | 3/1987 | Vaughn . | |
| D. 289,982 | 5/1987 | Weder et al. . | |
| D. 292,182 | 10/1987 | Weder et al. . | |
| D. 292,183 | 10/1987 | Weder et al. . | |
| D. 292,184 | 10/1987 | Weder et al. . | |
| D. 292,185 | 10/1987 | Weder et al. . | |
| D. 292,186 | 10/1987 | Weder et al. . | |
| D. 292,187 | 10/1987 | Weder et al. . | |
| D. 292,188 | 10/1987 | Weder et al. . | |
| D. 292,189 | 10/1987 | Weder et al. . | |
| D. 292,190 | 10/1987 | Weder et al. . | |
| D. 292,191 | 10/1987 | Weder et al. . | |
| D. 292,561 | 11/1987 | Weder et al. . | |
| D. 292,562 | 11/1987 | Weder et al. . | |
| D. 292,563 | 11/1987 | Weder et al. . | |
| D. 293,222 | 12/1987 | Weder et al. . | |
| D. 293,223 | 12/1987 | Weder et al. . | |
| D. 293,224 | 12/1987 | Weder et al. . | |
| D. 293,304 | 12/1987 | Weder et al. . | |
| D. 293,305 | 12/1987 | Weder et al. . | |
| D. 293,306 | 12/1987 | Weder et al. . | |
| D. 293,307 | 12/1987 | Weder et al. . | |
| D. 293,308 | 12/1987 | Weder et al. . | |
| D. 293,774 | 1/1988 | Weder et al. . | |
| D. 293,775 | 1/1988 | Weder et al. . | |
| D. 296,535 | 7/1988 | Weder et al. . | |
| D. 297,422 | 8/1988 | Weder et al. . | |
| D. 298,017 | 10/1988 | Weder et al. . | |
| D. 300,911 | 5/1989 | Allen . | |
| D. 320,765 | 10/1991 | Sypien | D11/164 |
| D. 326,246 | 5/1992 | Weder | D11/164 X |
| D. 326,627 | 6/1992 | Quinlan | D11/152 |
| D. 326,830 | 6/1992 | Vaughn | D11/143 |
| D. 327,234 | 6/1992 | Vaughn . | |
| D. 327,236 | 6/1992 | Weder | D11/164 X |
| D. 359,932 | 7/1995 | Weder et al. | D11/164 |
| D. 360,167 | 7/1995 | Weder et al. | D11/164 |
| D. 363,450 | 10/1995 | Weder et al. | D11/164 |
| D. 365,043 | 12/1995 | Bonds | D11/164 |
| D. 375,918 | 11/1996 | Weder et al. | D11/164 |
| D. 421,729 | 3/2000 | Sedora et al. | D11/164 |

(List continued on next page.)

FOREIGN PATENT DOCUMENTS

| | | | |
|---|---|---|---|
| 199 00 755 A1 | 6/1999 | Germany | 47/72 |

*Primary Examiner*—Robert P. Swiatek
*Assistant Examiner*—Jeffrey L. Gellner
*Attorney, Agent, or Firm*—Andrus, Sceales, Starke & Sawall

[57] ABSTRACT

A cover sleeve (52) is provided for a pot (54), such as a flowerpot. The sleeve extends along the sidewall (64) of the pot and around upper and lower corners (66 and 68) of the pot and has flat horizontal upper and lower portions (70 and 72) lying in respective horizontal planes (58 and 62). The sleeve is composed of an air permeable elastic material.

21 Claims, 10 Drawing Sheets

U.S. PATENT DOCUMENTS

| | | | |
|---|---|---|---|
| 1,486,705 | 3/1924 | Walker . | |
| 1,856,179 | 5/1932 | Wells . | |
| 2,209,778 | 7/1940 | Krasowski . | |
| 2,302,259 | 11/1942 | Rothfuss | 47/72 |
| 2,355,559 | 8/1944 | Renner | 47/72 |
| 2,440,569 | 4/1948 | Baldwin . | |
| 2,606,106 | 8/1952 | Albertson . | |
| 2,884,741 | 5/1959 | Lange . | |
| 3,001,753 | 9/1961 | Smith . | |
| 3,961,443 | 6/1976 | Insalaco . | |
| 4,031,663 | 6/1977 | Brunk . | |
| 4,300,312 | 11/1981 | Weder et al. . | |
| 4,395,845 | 8/1983 | Markowitz . | |
| 4,594,211 | 6/1986 | Mohnhaupt . | |
| 4,733,521 | 3/1988 | Weder et al. . | |
| 4,771,573 | 9/1988 | Stengel . | |
| 4,773,182 | 9/1988 | Weder et al. . | |
| 4,795,601 | 1/1989 | Cheng . | |
| 4,835,834 | 6/1989 | Weder . | |
| 4,897,031 | 1/1990 | Weder et al. . | |
| 4,901,423 | 2/1990 | Weder . | |
| 4,914,860 | 4/1990 | Richardson . | |
| 4,950,216 | 8/1990 | Weder . | |
| 5,553,733 | 9/1996 | Rosenthal | 220/400 |
| 5,781,981 | 7/1998 | Weder et al. | 47/72 X |
| 5,924,241 | 6/1999 | Hodge | 47/72 |

FIG. 1
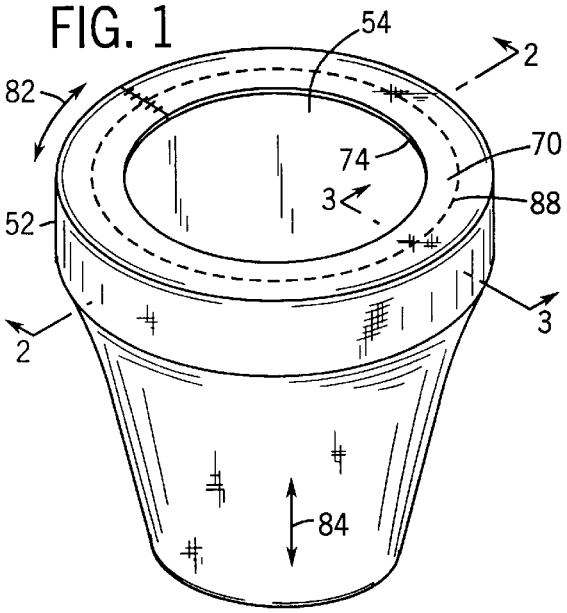
FIG. 4
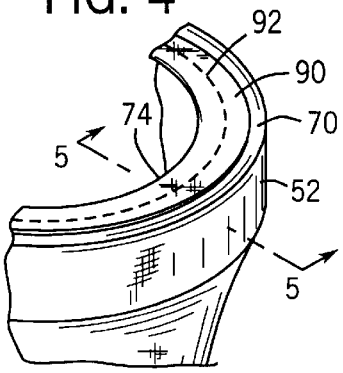
FIG. 5
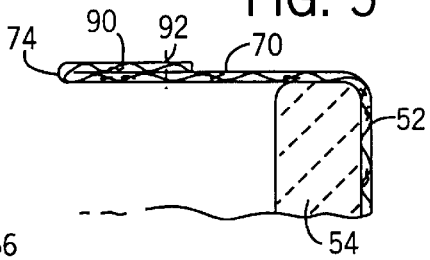
FIG. 2
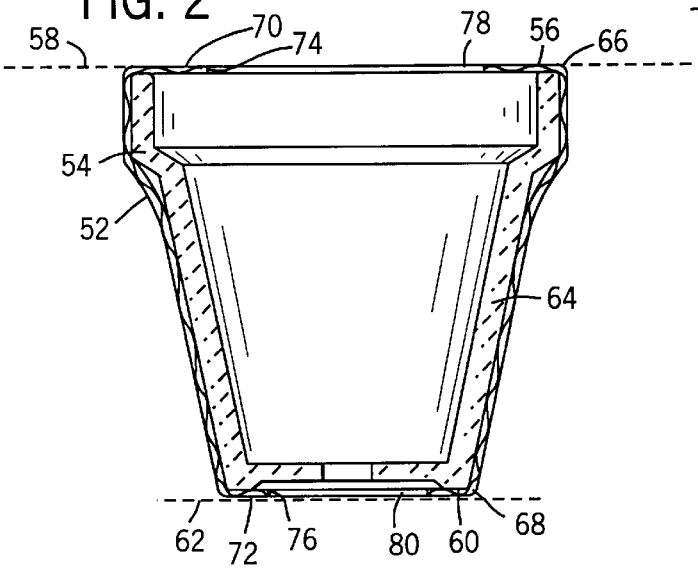
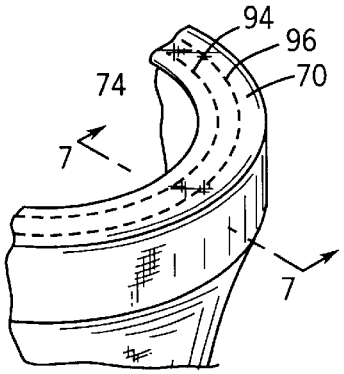
FIG. 6
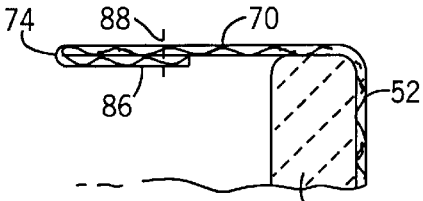
FIG. 3
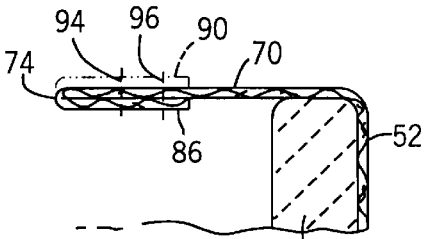
FIG. 7

FIG. 13
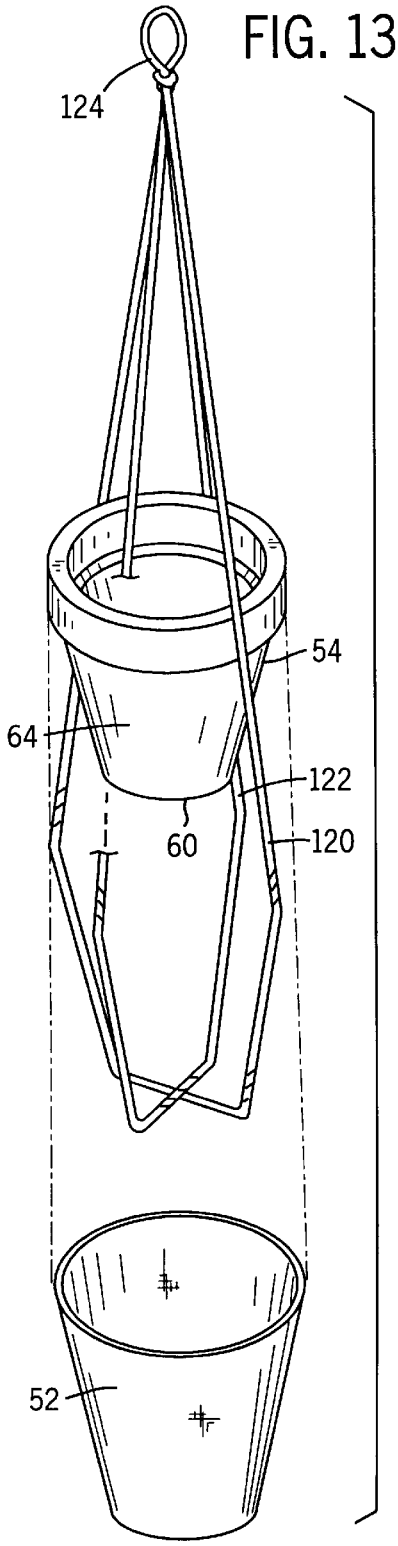
FIG. 14
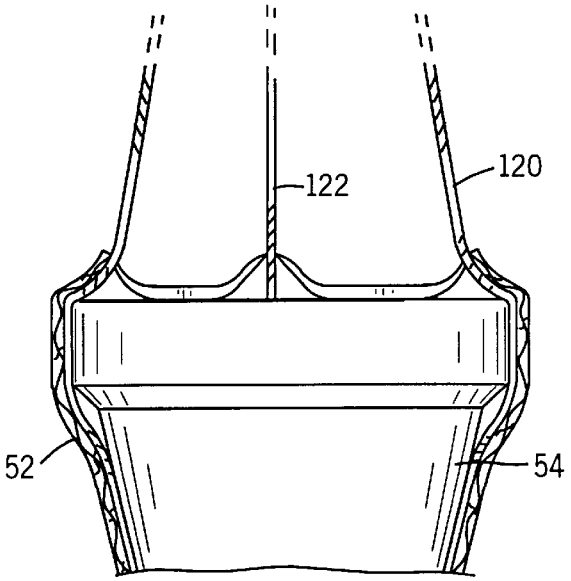
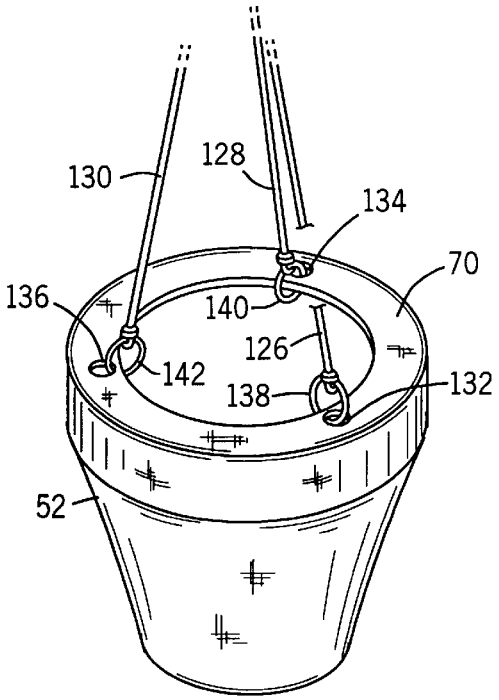
FIG. 15

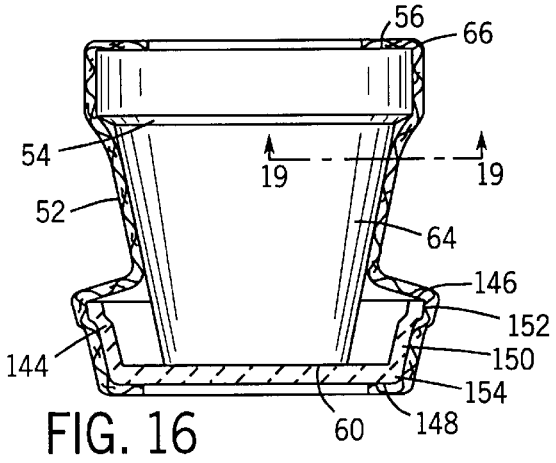
FIG. 16
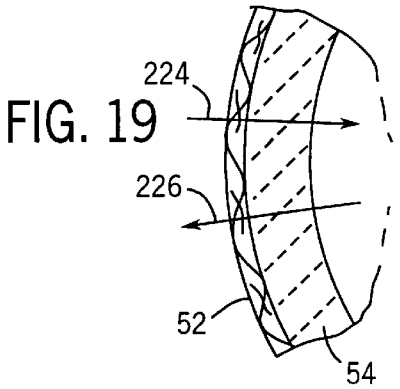
FIG. 19
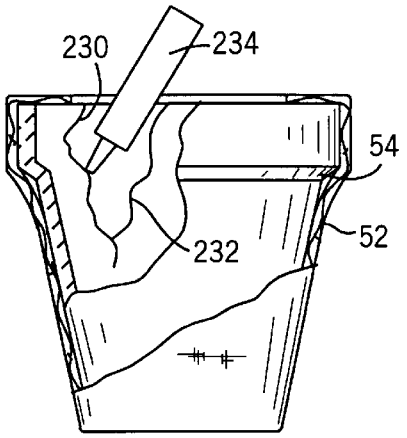
FIG. 20
FIG. 17
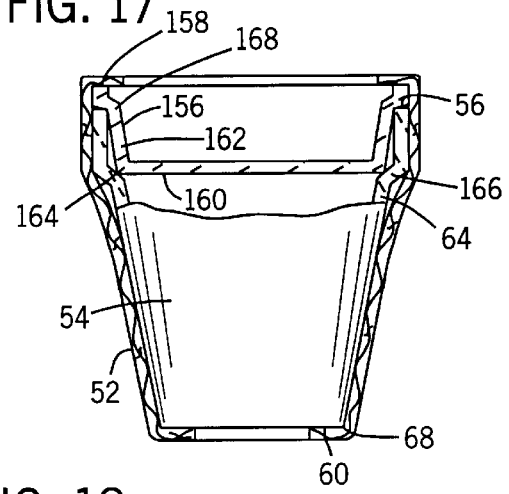
FIG. 18
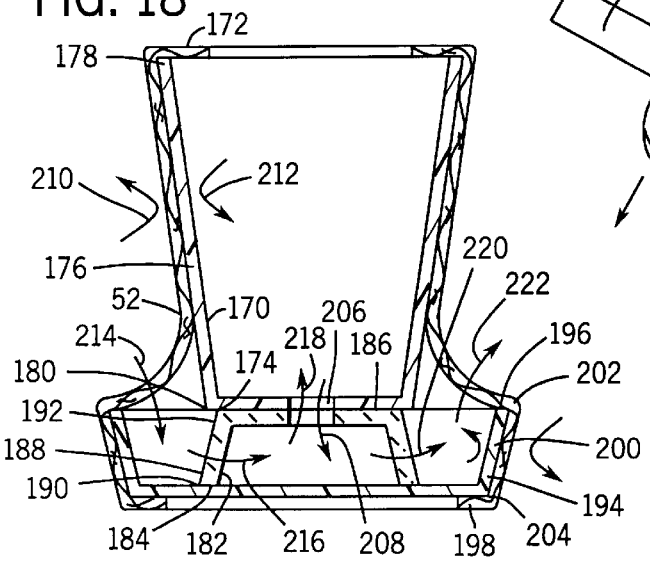
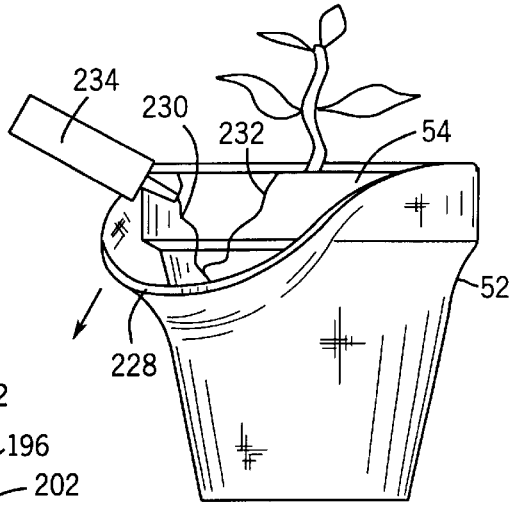
FIG. 21

FIG. 27
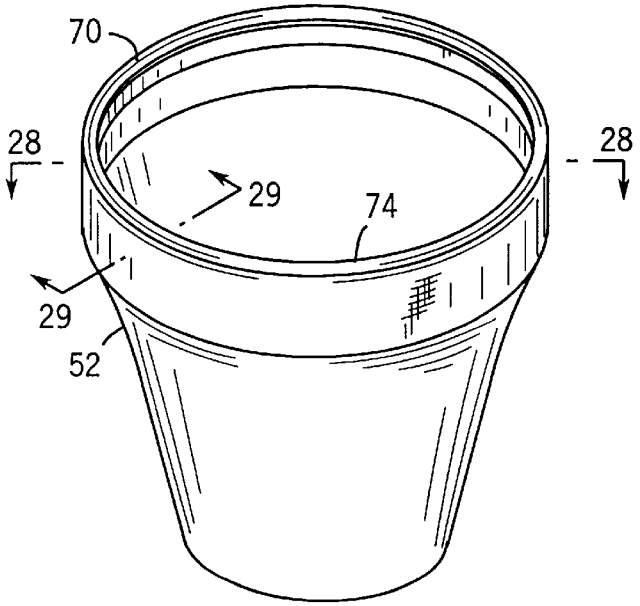
FIG. 29
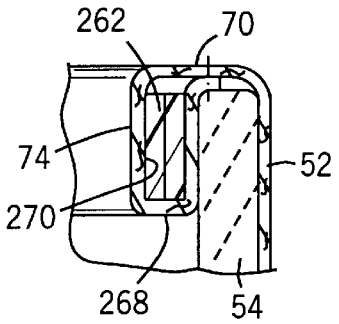
FIG. 28
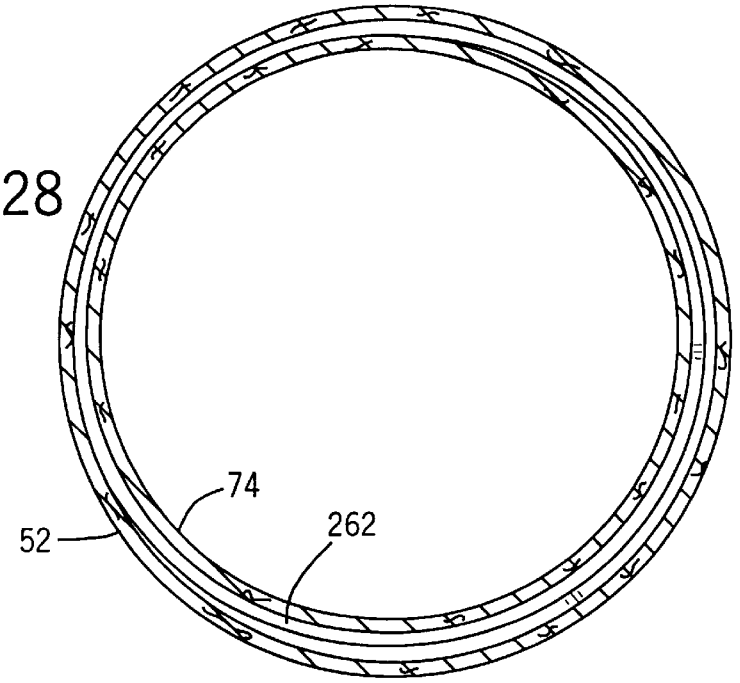
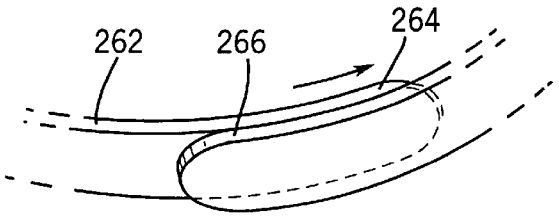
FIG. 30

COVER SLEEVE FOR POT

BACKGROUND AND SUMMARY OF THE INVENTION

The invention relates to cover sleeves for pots, including flower pots. The invention arose from continuing development efforts directed toward providing cover sleeves for flower pots which are not only aesthetically pleasing but also provide functional advantages, ease of manufacture, and accommodate varying pot sizes including variances in standard sizes. The invention also arose out of continuing development efforts relating to the subject matter of commonly owned copending U.S. application Ser. No. 29/089,316, filed Jun. 12, 1998, incorporated herein by reference.

BRIEF DESCRIPTION OF THE DRAWINGS

FIG. 1 is a perspective view of a cover sleeve in accordance with the invention.

FIG. 2 is a sectional view taken along line 2—2 of FIG. 1.

FIG. 3 is a sectional view taken along line 3—3 of FIG. 1.

FIG. 4 is a view like a portion of FIG. 1 and shows a further embodiment.

FIG. 5 is a sectional view taken along line 5—5 of FIG. 4.

FIG. 6 is a view like a portion of FIG. 1 and shows a further embodiment.

FIG. 7 is a sectional view taken along line 7—7 of FIG. 6.

FIG. 13 is a view like FIG. 11 and shows a further embodiment.

FIG. 14 is a side view partially in section of a portion of FIG. 13 in assembled condition.

FIG. 15 is a view like FIG. 1 and shows a further embodiment.

FIG. 16 is a side view partially in section showing a further embodiment.

FIG. 17 is a side view partially in section showing a further embodiment.

FIG. 18 is a side sectional view showing a further embodiment.

FIG. 19 is a sectional view taken along line 19—19 of FIG. 16.

FIG. 20 is a side view partially in section and illustrates a repair method.

FIG. 21 is a view like FIG. 20 and further illustrates the repair method.

FIG. 27 is a perspective view showing a further embodiment.

FIG. 28 is a sectional view taken along line 28—28 of FIG. 27.

FIG. 29 is a sectional view taken along line 29—29 of FIG. 27.

FIG. 30 is an isolated perspective view of a portion of the structure of FIG. 27.

DETAILED DESCRIPTION OF THE INVENTION

Figure 8:
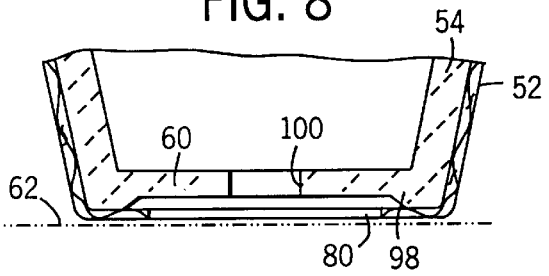
FIG. 8 is an enlarged view of a portion of FIG. 2.

FIGS. 1 and 2 show a cover sleeve 52 for a pot 54, such as a flowerpot, having a top 56 lying in a first horizontal plane 58, a bottom 60 lying in a second horizontal plane 62, a sidewall 64 extending between top 56 and bottom 60, an upper corner 66 at the interface of top 56 and sidewall 64, and a lower corner 68 at the interface of bottom 60 and sidewall 64. Sleeve 52 extends along sidewall 64 and around upper and lower corners 66 and 68. Sleeve 52 has a flat horizontal annular upper portion 70 lying in horizontal plane 58, and a flat horizontal annular lower portion 72 lying in horizontal plane 62. Upper portion 70 of the sleeve extends horizontally inwardly along horizontal plane 58 to inner lip 74 coplanar with upper corner 66 along horizontal plane 58. Lower portion 72 of the sleeve extends horizontally inwardly along horizontal plane 62 to inner lip 76 coplanar with lower corner 68 along horizontal plane 62. Upper and lower portions 70 and 72 of the sleeve are parallel. Inner lip 74 defines an upper central opening 78. Inner lip 76 defines a lower central opening 80 coaxially aligned with and of smaller diameter than upper central opening 78. Upper portion 70 of the sleeve terminates in horizontal plane 58, and lower portion 72 of the sleeve terminates in horizontal plane 62.

Figure 31:
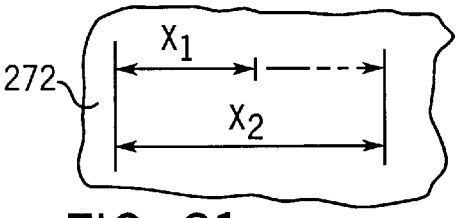
FIGS. 31–38 schematically illustrate method steps in accordance with the invention.

In the preferred embodiment, sleeve 52 is composed of an air permeable elastic material. The air permeability provides breathability, FIG. 19, for healthier soil and plant life in the pot. Clay flower pots are air permeable and hence breathable. The noted elasticity is preferred to provide a conformed fit of the sleeve around the pot, and to facilitate stretchability enabling insertion of the pot into the sleeve, or stated another way, sliding of the sleeve around the pot. The pot has a hoop direction 82, FIG. 1, along the circumference thereof, and an axial direction 84 along the height thereof between top 56 and bottom 60. The sleeve comprises material stretchable along at least one of such directions, i.e. along the X direction, as shown in FIG. 31 which will become hoop direction 82 and/or along the Y direction in FIG. 32 which will become axial direction 84. Depending upon applications, to be described, material stretchable along only one of such directions may be sufficient and may be desirable for cost savings. It is preferred, however, that the sleeve comprise material stretchable along both of such directions, to accommodate both height and diameter variances in pots. This is desirable for so-called standard size pots. For example, American manufactured pots typically identify same according to the pot diameter across top 56 from outer corner to outer corner, whereas Italian manufactured pots identify size by a diameter measurement across top 56 from an inside corner to an outside corner. Even manufacturers within countries may differ on how they measure pot dimensions. Thus, a standard 4 inch pot may in fact measure 4½ inches or some other dimension depending on the type of measurement system used.

In preferred form, sleeve 52 is formed of polyester material, preferably lycra, and further preferably tight weave nylon lycra fiber providing stretchability along both the hoop and the axial directions. In a further embodiment the sleeve is a multi-layer composite having a first layer comprising material stretchable along both of the noted hoop and axial directions, and a second layer coated on the first layer. In one embodiment, such second layer is polyurethane and provides a leather-look, or alternatively a grained look, or alternatively a vinyl look. A drawback of such second layer coating is that it is not as elastic as the noted first layer and hence reduces stretchability thereof. In such embodiment, a first layer stretchable in both of the noted directions is desirable to compensate for some of the reduced stretchability of the second layer.

Sleeve 52 as a folded-back portion 86, FIG. 3, extending horizontally outwardly from inner lip 74 and along and engaging upper portion 70 and stitched thereto at circumferential stitch 88, FIGS. 1 and 3. In FIGS. 1 and 3, folded-back portion 86 engages the underside of upper portion 70. In FIGS. 4 and 5, folded-back portion 90 engages the topside of upper portion 70 and is stitched thereto at circumferential stitch 92. Circumferential stitches 88 and 92 lie in horizontal plane 58. In a further embodiment, FIGS. 6 and 7, folded-back portion 86 is double stitched to upper portion 70 by a pair of concentric circumferential stitches 94 and 96. In FIG. 7, folded-back portion 86 engages the underside of upper portion 70. In an alternate embodiment, folded-back portion 90, shown in dashed line in FIG. 7, engages the topside of upper portion 70.

The bottom 60, FIG. 8, of the pot has an outer circumferential, downwardly-facing annular shoulder 98 spacing bottom 60 slightly above a lower supporting surface on which shoulder 98 rests, as is standard. Bottom 60 has a central aperture 100 therethrough aligned with and of smaller diameter than lower central opening 80 of sleeve 52.

Figure 9:
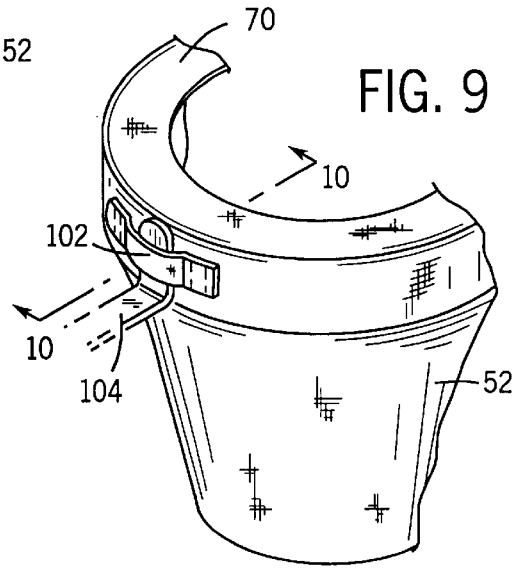
FIG. 9 is a view like a portion of FIG. 1 and shows a further embodiment.
Figure 10:
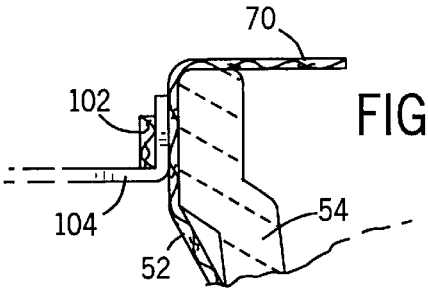
FIG. 10 is a sectional view taken along line 10—10 of FIG. 9.

In FIG. 9, a tab 102 is attached to sleeve 52 for receiving a mounting arm 104 for suspending the pot and sleeve therefrom. Tab 102 is preferably stitched to sleeve 52 and provides a loop for receiving arm 104, FIG. 10.

Figure 11:
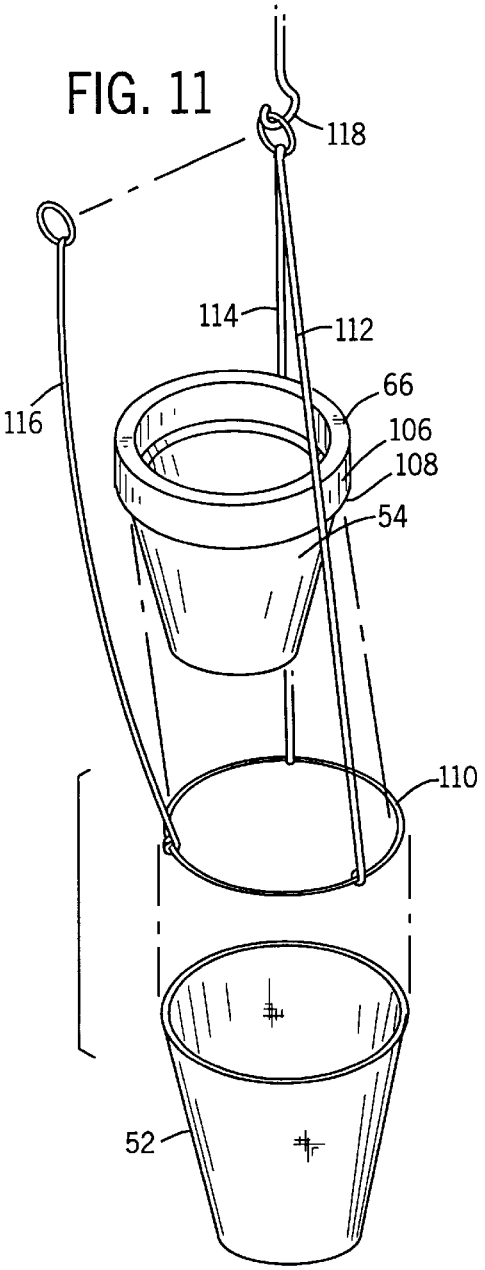
FIG. 11 is a perspective view showing a further embodiment.
Figure 12:
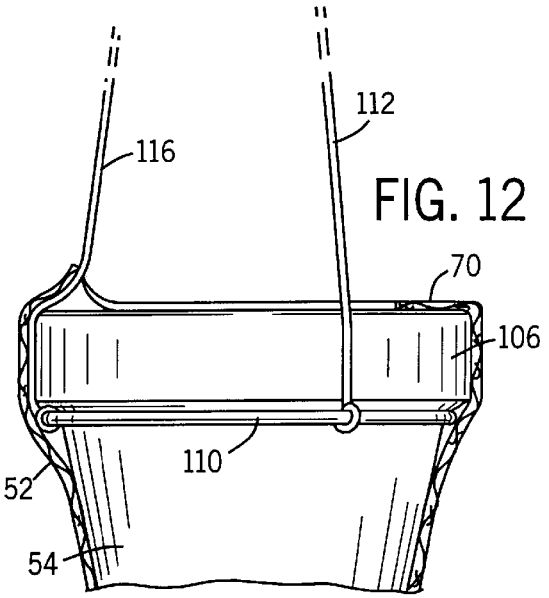
FIG. 12 is a side view partially in section of a portion of FIG. 11 in assembled condition.

As seen in FIG. 11, pot 54 has an outer upper band portion 106 extending downwardly from upper corner 66 and then inwardly at a downwardly-facing shoulder 108. A suspension hoop 110 engages the underside of shoulder 108 to suspend pot 54 therefrom. A plurality of stringers 112, 114, 116 are attached to hoop 110 and extend upwardly for mounting to a hook 118. Hoop 110 and portions of stringers 112, 114, 116, are trapped between pot 54 and sleeve 52, FIGS. 11 and 12. In FIG. 11, sleeve 52 is shown in an expanded stretched condition ready for receiving pot 54. Hoop 110 is held in place against the underside of shoulder 108 by sleeve 52, FIG. 12, including when unmounted to hook 118.

In FIG. 13, a plurality of stringers 120, 122 extend along sidewall 64 of pot 54 and around the bottom 60 of the pot, and have upper portions extending upwardly for mounting to a hook 124. Stringers 120, 122 are trapped between pot 54 and sleeve 52, FIG. 14, and are held in place by conformance of the sleeve to the pot.

In FIG. 15, a plurality of stringers 126, 128, 130 are attached to upper portion 70 of sleeve 52 and extend upwardly therefrom for mounting to a hook, such as 118. Upper portion 70 of the sleeve has a plurality of apertures 132, 134, 136 therethrough at which stringers 126, 128, 130 are respectively attached by respective rings 138, 140, 142.

In FIG. 16, a second pot 144 has a top 146, a bottom 148, a sidewall 150 extending between top 146 and bottom 148, an upper corner 152 at the interface of top 146 and sidewall 150, and a lower corner 154 at the interface of bottom 148 and sidewall 150. The diameter of bottom 148 of pot 144 is greater than the diameter of bottom 60 of pot 54. The height of sidewall 150 of pot 144 is less than the height of sidewall 64 of pot 54. Sleeve 52 extends around upper corner 66 of pot 54, then downwardly along sidewall 64 of pot 54, then around upper corner 152 of pot 144, then downwardly along sidewall 150 of pot 144, then around lower corner 154 of pot 144. Sleeve 52 holds pots 54 and 144 together, with the underside of bottom 60 of pot 54 against the topside of bottom 148 of pot 144. The diameter of top 146 of pot 144 is greater than the diameter of top 56 of pot 54.

In FIG. 17, a second pot 156 has a top 158, a bottom 160, a sidewall 162 extending between top 158 and bottom 160, and a lower corner 164 at the interface of bottom 160 and sidewall 162. The diameter of bottom 160 of pot 156 is less than the diameter of top 56 of pot 54. Sleeve 52 extends around top 158 of pot 156 then downwardly along sidewall 64 of pot 54 then around lower corner 68 of pot 54. Sleeve 52 holds pots 54 and 156 together, with the bottom 160 of pot 156 nested in the top of pot 54. Sidewall 64 of pot 54 has an annular shoulder 166 therein. Sidewall 162 of pot 156 has an annular should 168 therein. Top 56 of pot 54 faces shoulder 168. Lower corner 164 of pot 156 faces shoulder 166. In preferred form, shoulder 168 rests on top 56, and lower corner 164 rests on shoulder 166. The distance between top 56 and shoulder 166 is substantially equal to the distance between shoulder 168 and bottom 160. The diameter of shoulder 168 is substantially equal to the diameter of shoulder 166.

In FIG. 18, a first pot 170 has a top 172, a bottom 174, a sidewall 176 extending between top 172 and bottom 174, an upper corner 178 at the interface of top 172 and sidewall 176, and a lower corner 180 at the interface of bottom 174 and sidewall 176. A second pot 182 is inverted and has a downwardly facing top 184, an upwardly facing bottom 186, a sidewall 188 extending between top 184 and bottom 186, an upper corner 190 at the interface of top 184 and sidewall 188, and a lower corner 192 at the interface of bottom 186 and sidewall 188. Sleeve 52 holds pots 170 and 182 together in inverted relation, with the bottom 174 of pot 170 against the bottom 186 of pot 182, and with sidewall 176 of pot 170 extending downwardly from upper corner 178 of pot 170 to lower corner 180 of pot 170, and with sidewall 188 of pot 182 extending downwardly from lower corner 192 of pot 182 to upper corner 190 of pot 182. A third pot 194 has a top 196, a bottom 198, a sidewall 200 extending between top 196 and bottom 198, an upper corner 202 at the interface of top 196 and sidewall 200, and a lower corner 204 at the interface of bottom 198 and sidewall 200. Sleeve 52 holds pots 170, 182 and 194 together, with downwardly facing top 184 of pot 182 against bottom 198 of pot 194. Sleeve 52 extends around upper corner 178 of pot 170 then downwardly along sidewall 176 of pot 170 then around upper corner 202 of pot 194 then downwardly along sidewall 200 of pot 194 then around lower corner 204 of pot 194. Bottom 174 of pot 170 and upwardly facing bottom 186 of pot 182 have aligned openings 206 and 208 therein. Pot 170 is air impermeable, unlike pot 54 in previous figures. Pot 182 and sleeve 52 are air permeable. This embodiment is desirable for applications with commercial florists where a low cost air impermeable pot 170 is used, for example plastic, to hold soil and flowers. In such case, air cannot enter pot 170 through its sidewall 176, as shown at arrow 210, and air cannot exit pot 170 through sidewall 176, as shown at arrow 212. In FIG. 18, air enters as shown at arrow 214 through air permeable sleeve 52, then flows through air permeable pot 182 as shown at arrow 216, then flows through aligned openings 208 and 206 as shown at arrow 218 into the soil in pot 170. Air can escape as shown at arrows 220 and 222. This breathability enhances plant life while at the same time facilitating cost savings enabling the use of plastic or other air impermeable pots such as 170, rather than the more expensive clay pots such as 54. A clay or other air permeable pot is only used at pot 182. In the embodiments above-described, breathability is provided through air permeable sleeve 52 and clay or other air permeable pot 54, as shown at incoming air breathing arrow 224 in FIG. 19, and outgoing air breathing arrow 226.

As illustrated in FIG. 20, sleeve 52 holds pieces of pot 54 in assembled condition in the event of breakage. The pot may be repaired by pulling a portion 228, FIG. 21, of sleeve 52 away from pot 54 to allow access to cracks such as 230, 232 in the pot, permitting repair of the cracks. The cracks are repaired, for example by applying glue thereto as shown at glue applicator 234. The pulled-away portion 228 of the sleeve is then released to return to engagement against pot 54.

Figure 22:
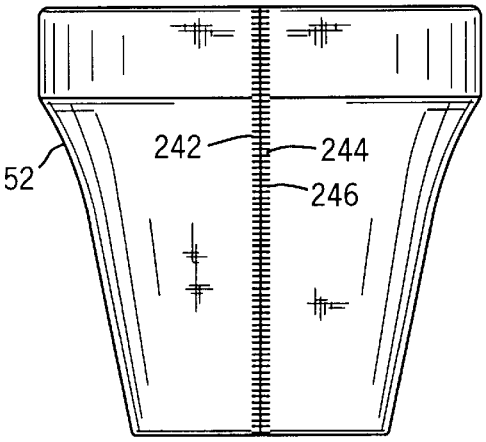
FIG. 22 is a side elevation view showing a further embodiment.
Figure 23:
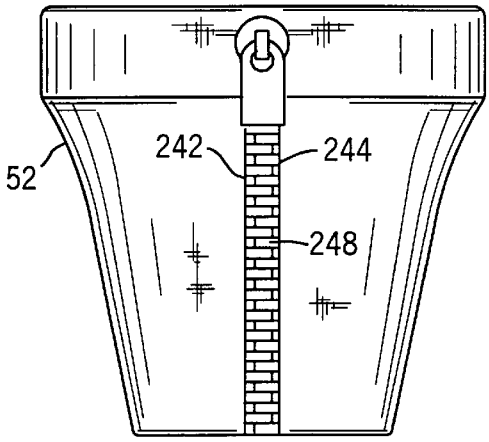
FIG. 23 is like FIG. 22 and shows a further embodiment.
Figure 24:
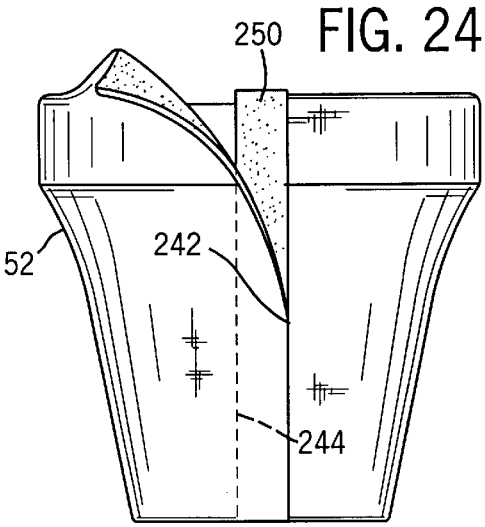
FIG. 24 is like FIG. 22 and shows a further embodiment.

As shown in FIG. 22, sleeve 52 has a pair of axial edges 242, 244 extending along axial direction 84, FIG. 1, and joined together along sidewall 64, FIG. 2, of pot 54. In FIG. 22, axial edges 242 and 244 are stitched together as shown at stitch 246. In FIGS. 23 and 24, axial edges 242 and 244 are releasably attached to each other. In FIG. 23, axial edges 242 and 244 are attached to each other by a zipper 248. In FIG. 24, axial edges 242 and 244 are attached to each other by a hook and loop fastener 250, sometimes called Velcro®.

Figure 25:
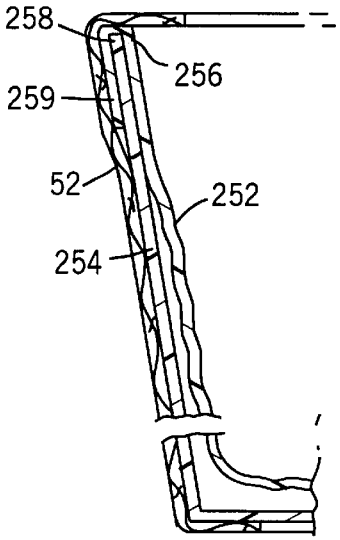
FIG. 25 is a partial sectional view showing a further embodiment.

In FIG. 25, a liner 252 is suspended in pot 254 by sleeve 52. Liner 252 has an upper circumferential reach 256 wedged between sleeve 52 and upper corner 258 of pot 254 to suspend liner 252 in pot 254. Liner 252 has an outer portion 259 extending from upper reach 256 downwardly along the exterior of pot 254 and held thereagainst by sleeve 52. Liner 252 holds the water in wet soil within the pot and prevents leakage. In another implementation, pot 254 with liner 252 may be used as a receptacle for various purposes and articles, such as a lined trash can.

Figure 26:
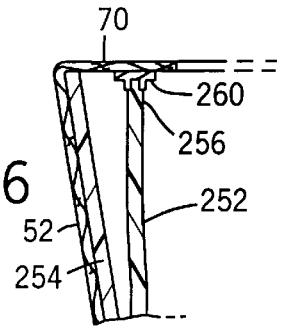
FIG. 26 is a view like a portion of FIG. 25 and shows a further embodiment.

In FIG. 26, upper reach 256 of liner 252 is attached to upper portion 70 of sleeve 52. Clip 260 is attached to upper portion 70 of sleeve 52 and suspends liner 252 therefrom. In FIG. 26, clip 260 is attached to the underside of upper portion 70 of sleeve 52.

In FIGS. 27–30, upper portion 70 of sleeve 52 extends inwardly to inner lip 74. A circumferential rim 262, FIG. 29, at inner lip 74 has overlapping ends 264, 266, FIG. 30, permitting expansion and contraction of rim 262 by sliding ends 264 and 266 circumferentially along each other. In this manner, the diameter of rim 262 may be expanded to permit insertion of pot 54 into sleeve 52, whereafter the diameter of rim 262 may be reduced to facilitate conforming fit of sleeve 52 around pot 54 including conformance of upper portion 70 of sleeve 52 extending around upper corner 66 of pot 54 and then radially inwardly to a smaller diameter at inner lip 74. Sleeve 52 has a folded-back portion 268, FIG. 29, extending outwardly from inner lip 74 and defining a circumferential channel 270 bounded by upper portion 70 and inner lip 74 and folded-back portion 268. Rim 262 is retained in circumferential channel 270.

Figure 32:
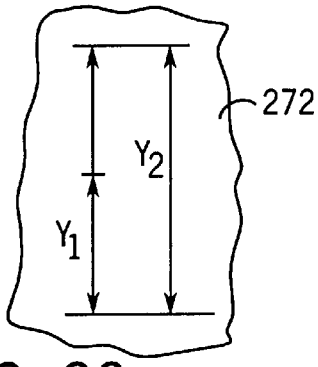

As illustrated in FIGS. 31–38, a method is provided for laying out a two-dimensional pattern for a cover sleeve for a pot such as 54. A fabric material 272, FIGS. 31 and 32, is selected which is stretchable along an X direction, left-right in FIG. 31, which will become the noted hoop direction 82, FIG. 1, and along a Y direction, up-down in FIG. 32, which will become the noted axial direction 84, FIG. 1. A given amount of stretch is determined along the X direction from a first X dimension $X_1$ to a second X dimension $X_2$. A given amount of stretch along the Y direction is determined from a first Y dimension $Y_1$ to a second Y dimension $Y_2$. A ratio is determined, $$\frac{X_1}{X_2} = K_x.$$

Another ratio is determined, $$\frac{Y_1}{Y_2} = K_y.$$

Figure 33:
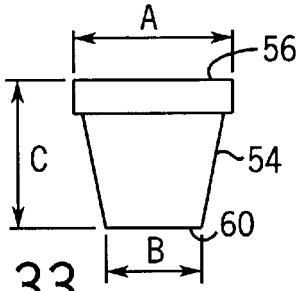
Figure 34:
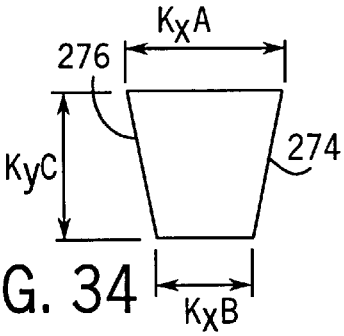
Figure 35:
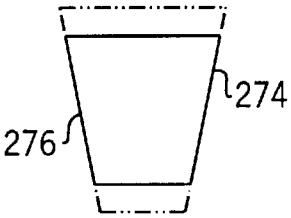
Figure 36:
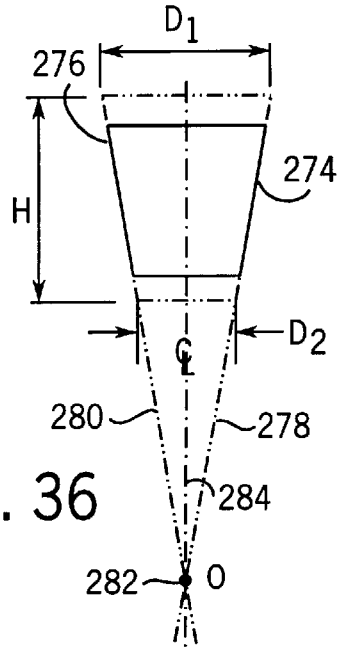
Figure 37:
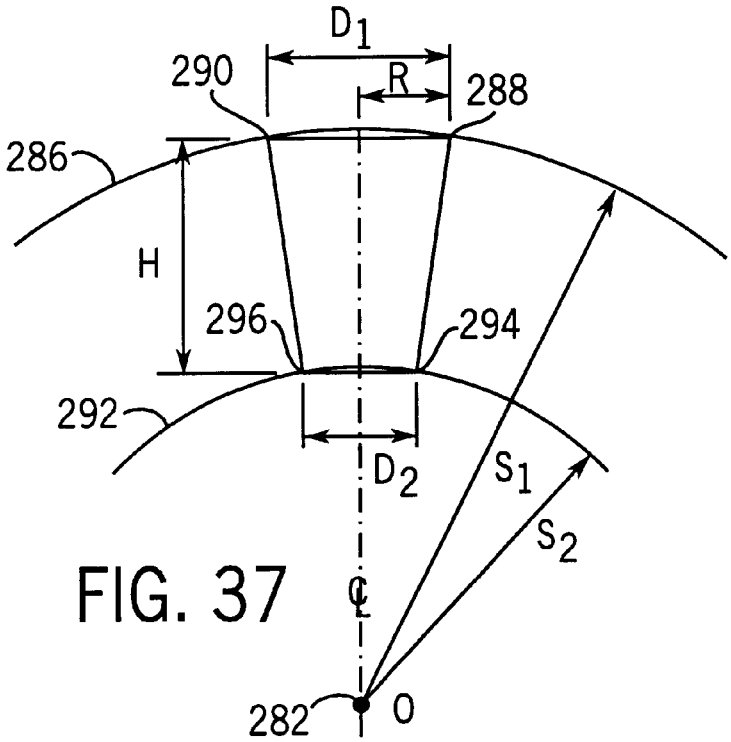

A product $K_xA$ is determined, where A is the diameter of top 56, FIGS. 2, 33. Another product $K_xB$ is determined, where B is the diameter of bottom 60. Another product $K_yC$ is determined, where C is the vertical height between top 56 and bottom 60 along axial direction 84. The profile of the sleeve is laid out on a two-dimensional plane, the profile having a top width $K_xA$, FIG. 34, a bottom width $K_xB$, and a height $K_yC$. The profile has tapered frustoconical right and left sidewalls 274 and 276. The profile of FIG. 34 is extended by extending each of the right and left sidewalls 274 and 276 upwardly along the frustoconical projection thereof to a width $D_1$ therebetween, FIGS. 35 and 36, where $D_1$ is greater than $K_xA$. The profile of FIG. 34 is extended by extending each of right and left sidewalls 274 and 276 downwardly along the frustoconical projection thereof to a width $D_2$ therebetween, FIGS. 35 and 36, where $D_2$ is less than $K_xB$. In some embodiments, particularly where the measurement system for a standard size pot is in question, the pattern may be additionally extended by extending $D_1$ and $D_2$ left-right, for extra hoop stretchability to accommodate diameter differences. Right and left sidewalls 274 and 276 are projected along respective right and left conical projection lines 278 and 280, FIG. 36, intersecting at a source point 282. A centerline 284 is extended from source point 282, bisecting $D_1$. A first arc 286, FIG. 37, is struck, intersecting right and left endpoints 288 and 290 of $D_1$ from a focal point at source point 282. Arc 286 has a radius $S_1$. A second arc 292 is struck, intersecting right and left endpoints 294 and 296 of $D_2$ from a focal point at source point 282. Arc 292 has a radius $S_2$. A cone radius R is determined according to $$R = \frac{D_1}{2}.$$

A pattern angle $\alpha$ is determined according to $$\alpha = \frac{R}{S_1} \times 360°.$$

Figure 38:
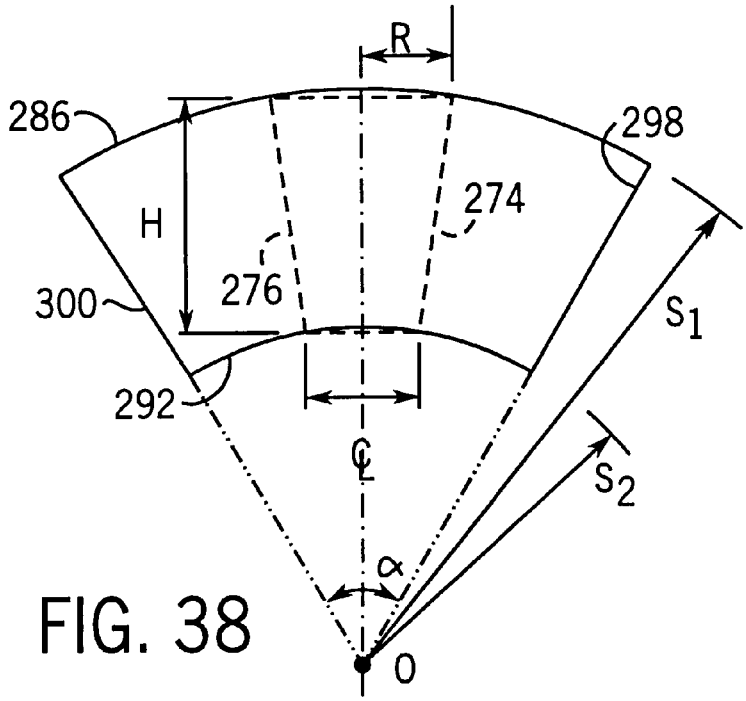
Figure 39:
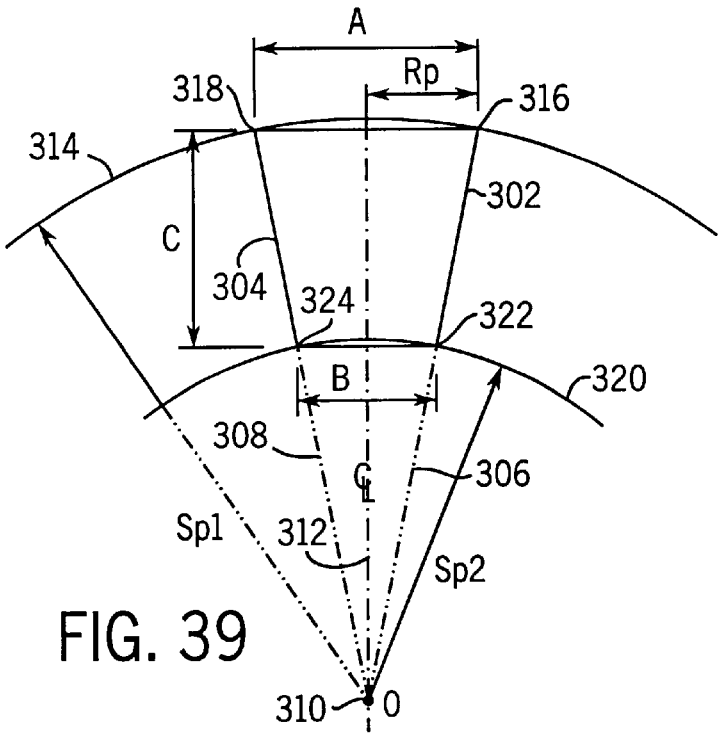
FIGS. 39–42 schematically illustrate further method steps in accordance with the invention.
Figure 40:
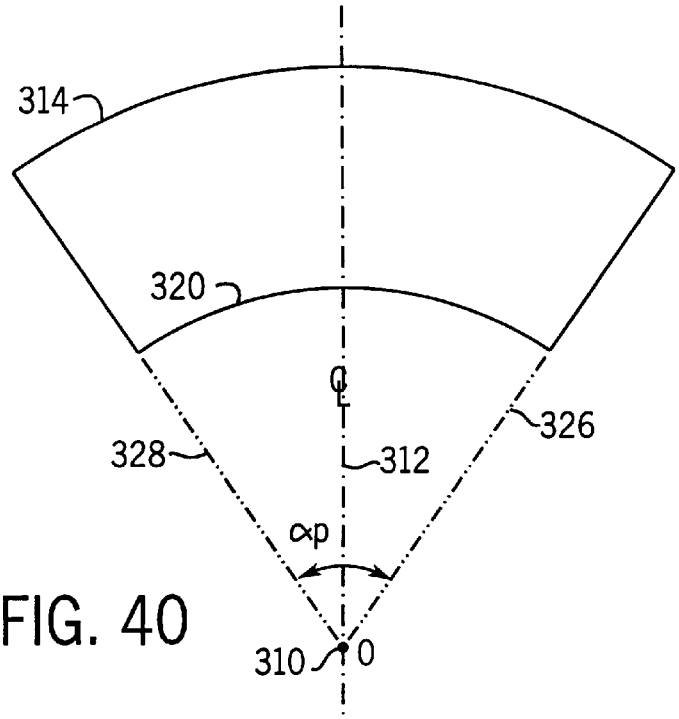
Figure 41:
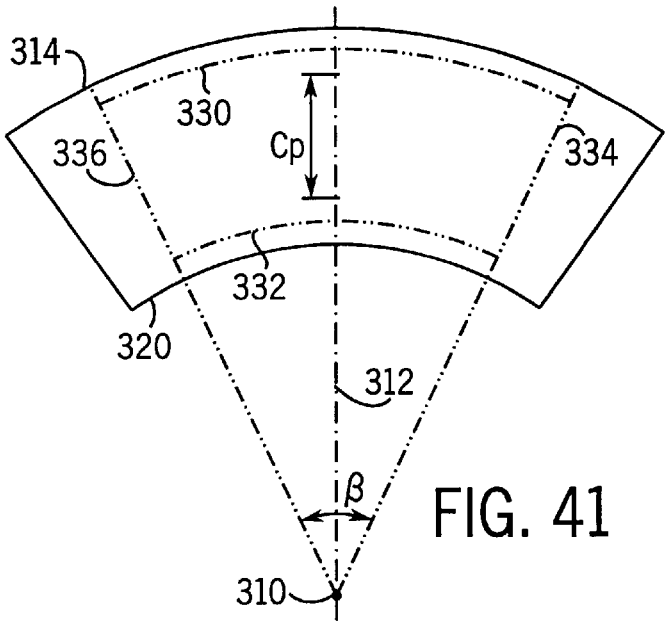
Figure 42:
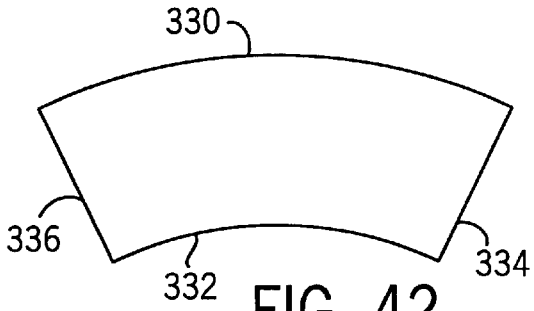

The pattern is determined by arcs 286 and 292 subtended by angle $\alpha$, FIG. 38. H is the height of the pattern along centerline 284. The pattern in FIG. 38 is bounded by outer arc 286, right side 298, inner arc 292, and left side 300. The fabric material is cut along the pattern shown in FIG. 38 as a template, and then formed into a frustoconical cone to provide sleeve 52.

In another method as illustrated in FIGS. 39–42, the profile of the pot is laid out on a two-dimensional plane. Such profile has a top width A, FIG. 39, a bottom width B, and a height C. The profile has tapered frustoconical right and left sidewalls 302 and 304. The right and left sidewalls are projected along respective right and left conical projection lines 306 and 308 intersecting at a source point 310. A centerline 312 is extended from source point 310, bisecting A. A first arc 314 is struck, intersecting right and left endpoints 316 and 318 from a focal point at source point 310. Arc 314 has a radius $S_{P1}$. A second arc 320 is struck, intersecting right and left endpoints 322 and 324 of B from a focal point at source point 310. Arc 320 has a radius $S_{p2}$. A cone radius $R_p$ of the profile is determined according to $$R_p = \frac{A}{2}.$$

A pot pattern angle $\alpha_P$ is determined according to $$\alpha_p = \frac{R_p}{S_{pl}} \times 360°.$$

Radial lines 326 and 328 are laid out from source point 310 at angle $\alpha_p$ subtending arcs 314 and 320. A product is determined according to $K_x\alpha_p=\beta$. A product is determined according to $K_yC=C_p$, FIG. 41. $C_P$ is then equally spaced along centerline 312 between arcs 314 and 320. Arc 314 is then contracted radially inwardly toward source point 310 to provide a contracted arc 330 subtended by angle β. Arc 320 is extended radially outwardly away from source point 310 to provide an extended arc 332 subtended by angle β. The pattern of the sleeve is determined by the contracted and extended arcs 330 and 332 subtended by angle β, to provide right and left sides 334 and 336, FIG. 42. The fabric material is cut along the pattern shown in FIG. 42 as a template, and then formed into a frustoconical cone to provide sleeve 52 as above-described. Contracted arc 330 is parallel to arc 314. Extended arc 332 is parallel to arc 320.

Figure 43:
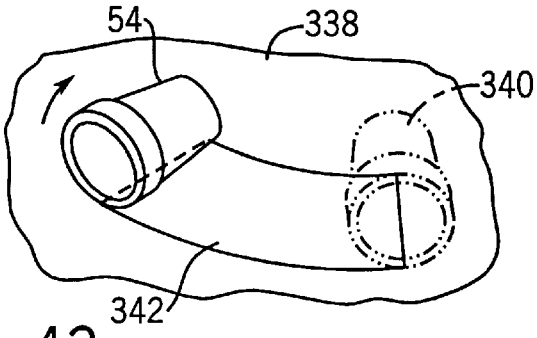
FIG. 43 illustrates a further method.

The methods described in FIGS. 31–38 and 39–42 are preferred over the manual method shown in FIG. 43 wherein pot 54 is rolled along fabric material 338 through one 360° revolution to the position shown in dashed line at 340 to provide pattern 342.

It is recognized that various equivalents, alternatives and modifications are possible within the scope of the appended claims.

What is claimed is:

1. A cover sleeve for a pot having a top lying in a first horizontal plane, a bottom lying in a second horizontal plane, a sidewall extending between said top and said bottom, an upper corner at the interface of said top and said sidewall, and a lower corner at the interface of said bottom and said sidewall, said sleeve extending along said sidewall and around said upper and lower corners and having a flat horizontal upper portion lying in said first horizontal plane, and a flat horizontal lower portion lying in said second horizontal plane, wherein said pot has a hoop direction along the circumference thereof, and an axial direction along the height thereof between said top and said bottom, and wherein said sleeve comprises material stretchable along at least one of said directions.

2. The invention according to claim 1 wherein said sleeve comprises material stretchable along both of said directions to accommodate both height and diameter variances in pots.

3. The invention according to claim 2 wherein said sleeve comprises a multi-layer composite comprising a first layer comprising said material stretchable along both of said directions, and a second layer coated on said first layer and reducing stretchability of said first layer.

4. The invention according to claim 3 wherein said second layer comprises polyurethane.

5. The invention according to claim 1 wherein said material comprises polyester.

6. The invention according to claim 1 wherein said material comprises lycra.

7. The invention according to claim 6 wherein said material comprises tight weave nylon lycra fiber.

8. A cover sleeve for a pot having a top lying in a first horizontal plane, a bottom lying in a second horizontal plane, a sidewall extending between said top and said bottom, an upper corner at the interface of said top and said sidewall, and a lower corner at the interface of said bottom and said sidewall, said sleeve extending along said sidewall and around said upper and lower corners and having a flat horizontal upper portion lying in said first horizontal plane, and a flat horizontal lower portion lying in said second horizontal plane, wherein said sleeve is composed of an air permeable elastic material.

9. A cover sleeve for a pot having a top lying in a first horizontal plane, a bottom lying in a second horizontal plane, a sidewall extending between said top and said bottom, an upper corner at the interface of said top and said sidewall, and a lower corner at the interface of said bottom and said sidewall, said sleeve extending along said sidewall and around said upper and lower corners and having a flat horizontal upper portion lying in said first horizontal plane, and a flat horizontal lower portion lying in said second horizontal plane, wherein said upper portion of said sleeve extends horizontally inwardly along said first horizontal plane to a first inner lip coplanar with said upper corner along said first horizontal plane, said lower portion of said sleeve extends horizontally inwardly along said second horizontal plane to a second inner lip coplanar with said lower corner along said second horizontal plane and parallel to said upper portion, and wherein said sleeve has a folded-back portion extending horizontally outwardly from said first inner lip and along and engaging said upper portion and stitched thereto.

10. The invention according to claim 9 wherein said folded-back portion engages the underside of said upper portion.

11. The invention according to claim 9 wherein said folded-back portion engages the topside of said upper portion.

12. The invention according to claim 9 wherein said folded-back portion is stitched to said upper portion by a circumferential stitch lying in said first horizontal plane.

13. The invention according to claim 9 wherein said folded-back portion is double stitched to said upper portion by a pair of concentric circumferential stitches.

14. A cover sleeve for a pot having a top lying in a first horizontal plane, a bottom lying in a second horizontal plane, a sidewall extending between said top and said bottom, an upper corner at the interface of said top and said sidewall, and a lower corner at the interface of said bottom and said sidewall, said sleeve extending along said sidewall and around said upper and lower corners and having a flat horizontal upper portion lying in said first horizontal plane, and a flat horizontal lower portion lying in said second horizontal plane, and comprising in combination a second pot having a top, a bottom, a sidewall extending between said top and said bottom of said second pot, and upper corner at the interface of said top of said second pot and said sidewall of said second pot, and a lower corner at the interface of aid bottom of said second pot and said sidewall of said second pot, the diameter of said bottom of said second pot being greater than the diameter of said bottom of said first pot, the height of said sidewall of said second pot being less than the height of said sidewall of said first pot, said sleeve extending around said upper corner of said first pot, then downwardly along said sidewall of said first pot, then around said upper corner of said second pot then downwardly along said sidewall of said second pot, then around said lower corner of said second pot, said sleeve holding said pots together, with the underside of said bottom of said first pot against the topside of said bottom of said second pot.

15. The invention according to claim 14 wherein the diameter of said top of said second pot is greater than the diameter of said top of said first pot.

16. A cover sleeve for a pot having a top lying in a first horizontal plane, a bottom lying in a second horizontal plane, a sidewall extending between said top and said bottom, an upper corner at the interface of said top and said sidewall, and a lower corner at the interface of said bottom and said sidewall, said sleeve extending along said sidewall and around said upper and lower corners and having a flat horizontal upper portion lying in said first horizontal plane, and a flat horizontal lower portion lying in said second horizontal plane, and comprising in combination a second pot held against said first pot by said sleeve.

17. The invention according to claim 16 wherein said sleeve and at least one of said pots is air permeable.

18. A cover sleeve for a pot having a top lying in a first horizontal plane, a bottom laying in a second horizontal plane, a sidewall extending between said top and said bottom, an upper corner at the interface of said top and said sidewall, and a lower corner at the interface of said bottom and said sidewall, said sleeve conforming to said pot and extending along said top and around said upper corner then along said sidewall then around said lower corner then along said bottom, said sleeve being composed of an air permeable elastic material.

19. The invention according to claim 18 wherein said pot has a hoop direction along the circumference thereof, and an axial direction along the height thereof between said top and said bottom, and wherein said sleeve comprises material stretchable along at least one of said directions.

20. The invention according to claim 19 wherein said sleeve comprises material stretchable along both of said directions to accommodate both height and diameter variances in pots.

21. The invention according to claim 20 wherein said sleeve comprises a multi-layer composite comprising a first layer comprising said materials stretchable along both of said directions, and a second layer coated on said first layer and reducing stretchability of said first layer.

* * * * *